United States Patent [19]

Vavrek et al.

[11] Patent Number: 4,646,046

[45] Date of Patent: Feb. 24, 1987

[54] SHIELDED ROOM CONSTRUCTION FOR CONTAINMENT OF FRINGE MAGNETIC FIELDS

[75] Inventors: Robert M. Vavrek; Nancy S. Grigsby, both of Waukesha, Wis.

[73] Assignee: General Electric Company, Milwaukee, Wis.

[21] Appl. No.: 673,692

[22] Filed: Nov. 21, 1984

[51] Int. Cl.[4] ..... H01F 7/00

[52] U.S. Cl. ..... 335/301; 335/211; 324/320

[58] Field of Search ..... 335/299, 301, 211; 324/318, 319, 320, 321

[56] References Cited

U.S. PATENT DOCUMENTS

| | | | |
|---|---|---|---|
| 3,423,670 | 1/1969 | Parker et al. | 335/301 X |
| 3,460,083 | 8/1969 | Johnson | 335/301 X |
| 4,409,579 | 10/1983 | Clem | 335/216 |
| 4,484,814 | 11/1984 | Kawaguchi et al. | 335/301 |
| 4,584,549 | 4/1986 | Brown et al. | 335/301 |

*Primary Examiner*—George Harris

*Attorney, Agent, or Firm*—Alexander M. Gerasimow; Douglas E. Stoner

[57] ABSTRACT

A shielded room for containment of magnetic fringe fields generated by a magnet which forms part of an NMR scanner system utilizes wall members having a thickness proportional to the amount of flux conducted. In the preferred embodiments, the shielded room can have one of rectangular, cylindrical, or polygonal geometries, for example. The walls (floors and ceilings) are constructed from staggered plates to have increased thickness where flux is greatest, and correspondingly decreased thickness where the flux is lowest. The shielded room can be, additionally, provided with end-cap elements in the walls perpendicular to the base of the magnet. Preferentially, the end-cap elements are angled away from the side wall members toward the center of the room to more closely follow the flux path.

26 Claims, 11 Drawing Figures

SHIELDED ROOM CONSTRUCTION FOR CONTAINMENT OF FRINGE MAGNETIC FIELDS

BACKGROUND OF THE INVENTION

This invention relates to shielded room construction for containment of fringe magnetic fields. More specifically, this invention relates to containment of fringe magnetic fields produced by a magnet which forms prt of a nuclear magnetic resonance (NMR) scanner.

The magnetic resonance phenomenon has been utilized in the past in high resolution NMR spectroscopy instruments by structural chemists to analyze the structure of chemical components. More recently, NMR has been developed as a medical diagnostic modality having application in imaging the anatomy, as well as in performing in vivo, non-invasive, spectroscopic analysis. As is now well known, the NMR resonance phenomenon can be excited within a sample object, such as a human patient, positioned in a homogeneous polarizing magnetic field, by irradiating the object with radio frequency (RF) energy at the Larmor frequency. In medical diagnostic applications, this is typically accomplished by positioning the patient to be examined in the field of an RF coil having a cylindrical geometry, and energizing the RF coil with an RF power amplifier. Upon cessation of the RF excitation, the same or a different RF coil is used to detect the NMR signals emanating from the patient volume lying within the field of the RF coil. The NMR signal is usually observed in the presence of linear magnetic field gradients used to encode spatial information into the signal. In the course of a complete NMR scan, a plurality of NMR signals are typically observed. The signals are used to derive NMR imaging or spectroscopic information about the object studied.

A typical whole-body NMR scanner used as a medical diagnostic device includes a magnet, usually of solenoidal design, having a cylindrical bore sufficiently large to accept a patient. The magnet is utilized to produce the polarizing magnetic field, which must be homogeneous typically to 1 part in a million for imaging applications and to in excess of 1 part in $10^7$ for spectroscopic studies. The field strength of the polarizing magnetic field can vary from 0.12 tesla (T) in electromagnets utilized for imaging applications to 1.5 tesla or more in superconductive magnets utilized for imaging as well as spectroscopic applications. It should be noted by way of comparison that the strength of the earth's magnetic field is approximately 0.7 gauss, whereas 1 tesla is equal to 10,000 gauss. Such strong magnetic fields, especially those in excess of 1T, are particularly useful in whole body NMR scanners. For specialized applications, suchas NMR spectroscopic studies, field strengths of 1T or greater are mandatory to detect useful NMR signals from such NMR-active nuclei as phosphorus ($^{31}P$) and carbon ($^{13}C$), for example.

Not unexpectedly, magnets capable of generating the field strengths referred to hereinabove, and having bores sufficiently large for accepting patients, generate fringe fields which can extend quite far from the magnet. Such fringe fields even at field strengths of 1 gauss can interfere with the normal operation of such devices commonly found in a hospital environment as computerized tomography (CT) scanners, nuclear tomographic cameras, and ultrasound systems. A fringe field strength of approximately 5 gauss is believed to have an adverse effect on cardiac pacemaker devices, neuro-stimulators, as well as other bio-stimulation devices. By way of illustration, the 5 gauss field can extend as far as 39 feet from the center of a magnet having a field strength of 1.5T and a 1 meter bore diameter. The necessity to contain the magnetic fringe fields, usually to 5 gauss, within the NMR scanner room is therefore apparent.

In the past, iron has been used to construct shielded rooms, housing the NMR scanner, for containment of magnetic field flux. However, conventionally designed shielded rooms have not made efficient use of the shielding material. Thus, for example, for containment of the 5 gauss field within a typical room for a 1.5T magnet system, the amount of iron needed can range from 50 to 90 tons. This can be a prohibitive amount of iron, due to economic and weight considerations, in situations where it is desirable to install an NMR scanner in an existing structure, as well as in new installations.

It is therefore an object of the invention to provide a technique for reducing the amounts of iron needed in the construction of shielded rooms.

It is another object of the invention to provide techniques for the construction of shielded rooms which effectively contain the MR field while making efficient use of shielding material.

SUMMARY OF THE INVENTION

In accordance with the invention, a shielded room for containing a fringe magnetic field generated by a magnet housed therein includes a shield composed of a material suitable for containment of the fringe field. The shield has a variable thickness, to optimize the use of shielding material, proportioned to the strength of the fringe field in a particular region. In general, the shield thickness in any given region is selected so as not to exceed by a substantial amount the thickness required to contain the magnetic field without saturating the material.

Exemplary shield embodiments include cylindrical and polygonal, as well as rectangular, configurations.

Other embodiments of the inventive shielded room include end-cap elements to further enhance shield performance.

BRIEF DESCRIPTION OF THE DRAWINGS

The features of the invention believed to be novel are set forth with particularity in the appended claims. The invention itself, however, both as to its organization and method of operation, together with further objects and advantages thereof, may best be understood by reference to the following decription taken in conjunction with the accompanying drawings in which:

DETAILED DESCRIPTION OF THE INVENTION

Figure 1:
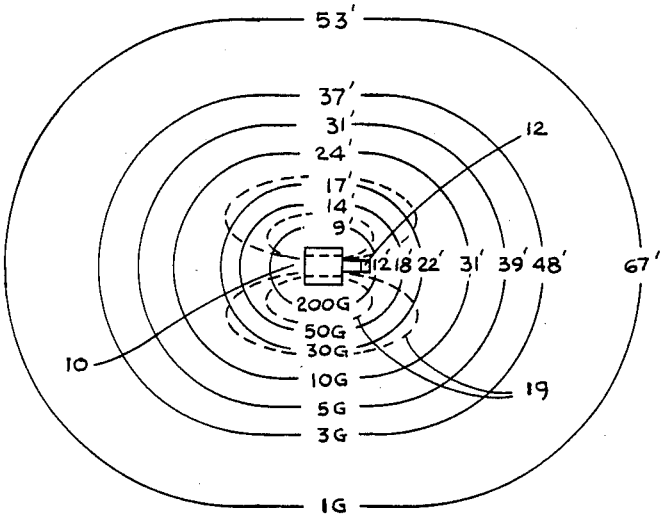
FIG. 1 depicts a two-dimensional isogauss line plot for a 1.5T magnet.

FIG. 1 depicts a two-dimensional isogauss line plot for a 1.5T magnet 10 of superconductive design which has a patient transport table 12 docked to the bore thereof indicated by the dash lines within the block designating the magnet. A field strength of 1.5T is achieved within the bore in the region where the patient is positioned for carrying out the NMR study. In reality, however, the magnetic field strength drops off with increased distance form the magnet. This is apparent by reference to FIG. 1 where at a distance of 67 feet, in a direction aligned with the longitudinal axis of the bore, field strength decreases to approximately 1 gauss. Similarly, in a direction perpendicular to the axis of the bore the 1 gauss line occurs at a distance of 53 feet. In general, it is desired to reduce the fringe field strength outside the NMR examination room to approximately 5 gauss or less. This can be achieved without utilizing shielding if the room is constructed to be 31×39 feet, as is evident from FIG. 1. In most cases, such room dimensions are unacceptably large so that it becomes necessary to utilize a shield around the periphery of the examination room to limit the fringe field to the desired 5 gauss, or less.

Figure 2:
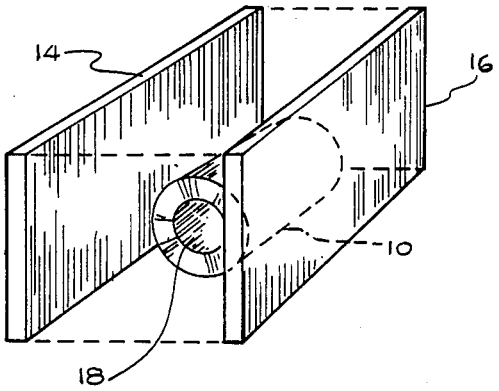
FIG. 2 depicts conventional construction of a shielded room with floor and ceiling omitted to preserve figure clarity.

FIG. 2 illustrates a shielded room of conventional design having side walls 14 and 16 disposed substantially parallel to bore 18 of magnet 10 and tangentially to the normal path of the magnetic field flux. The path of the flux lines is suggested in FIG. 1 by dashed lines 19 which emanate from one bore opening and re-enter at the other. In such conventionally designed shielded rooms, side wall members 14 and 16, as well as the ceiling and floor members (which have been omitted to preserve figure clarity), are typically constructed with iron plates having uniform thicknesses throughout. As indicated hereinbefore, a typical conventional room for a 1.5T magnet system with a 1 meter bore, the amount of iron needed to shield the room is approximately between 50 and 90 tons. This can be a prohibitive amount of iron unless methods are employed to reduce the weight of the shield.

Figure 3:
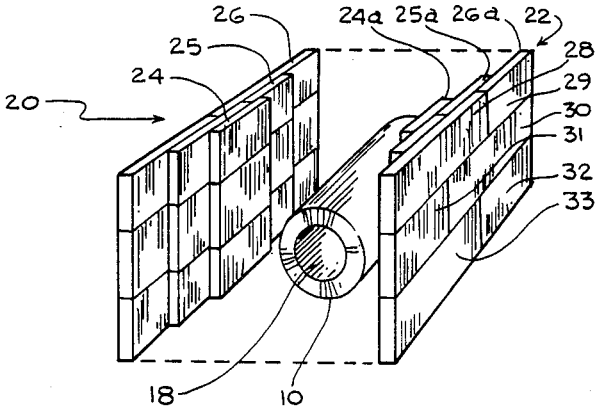
FIG. 3 depicts one exemplary embodiment of shielded room construction in accordance with the invention, with floor and ceiling omitted to preserve figure clarity.

Referring now to FIG. 3, there is shown one embodiment of a shielded room in accordance with the invention. Again, to preserve figure clarity the floor and ceiling members are omitted. It should be noted, however, that the description of the side walls applies to the floor and ceiling. It should be further noted that in some shielded room installations shielding may not be needed in all directions so that, for example, the shielded room comprises either side-wall members or floor and ceiling members, or some other combination thereof. In FIG. 3, side walls members 20 and 22 are disposed parallel to the bore of the magnet and constructed to have variable thicknesses optimized to reduce the weight of the shield while containing the fringe field. This is achieved by recognizing that the thickness of the shield walls should be proportional to the amount of magnetic flux that it is conducting. In this manner, a constant flux density is maintained within the material.

In one preferred embodiment illustrated in FIG. 3, the shielded room is constructed from staggered plates, such as those designated 24, 25, and 26, having varying lengths such that the maximum thickness of the shield wall occurs in the region where the magnetic flux is maximum. For a typical room (20×28 feet) housing a 1.5T magnet, a shield 3 inches thick at the center of the room can be reduced to 1 inch at the corners of the room. To optimize the use of the shielding material, maximum thickness in any given region of the shield should be such that the flux density within the side wall member is just under the saturation value for the material being used. It has been found that steel having low carbon content, such as that bearing standard industry designations either C1010 or C1008, is suitable. This technique can result in substantial weight reduction of the shield with a minimal impact on fringe field containment. It is estimated that a shield designed in accordance with the invention could provide 40 percent reduction in weight compared to the conventionally designed shield.

While it is possible to construct walls 20 and 22 in FIG. 3 from a single piece of steel having a continuously varying thickness to contain a particular flux configuration, in the preferred embodiment of the invention the side wall members are constructed from several rectangular plates, such as those designated 24, 25, and 26, forming part of side wall 20 so that side-wall thickness varies incrementarily. Plates 24–26 are bolted to one another to form an integral wall structure, such that the longest plate 26 is outermost, while the shortest plate 24 is innermost. Plate 25, which is of intermediate length, is interposed between plates 24 and 26. It should be noted that the order of the plates could be reversed so that plate 24 is outermost, while plate 26 is innermost without adversely affecting shield efficacy. Each of plates 24–26 can be further constructed from smaller plates, such as those designated 28–33, comprising plate 26a in side wall 22. In order to avoid unnecessarily impeding the conduction of magnetic flux through the plates, in the preferred embodiment, plates 28–33 are selected to be as long as possible. In the event it becomes necessary to join shorter segments, such as segment pairs 28–29, 30–31, and 32–33, the joints should be staggered relative to one another so that continuous portions of an adjacent plate, such as 25*a*, bridge the vertical gaps to provide a stagger joint described below with reference to FIG. 4.

In situations where it is impossible to avoid gaps perpendicular to the flux path, as discussed above, it is desirable to provide a method for joining the plates which provides an alternative flux path around the gap. Welding is one technique which could be utilized for joining the plates to form a continuous path through the material. It is believed, however, that welding may degrade the magnetic properties of the material, thereby impairing its ability to conduct flux. Additionally, the magnetic flux-conducting quality of the welded joint is not easily determinable. Therefore, in the preferred embodiments of the invention, the staggered or lap joints, depicted in FIGS. 4 and 5, respectively, are utilized.

Figure 4:
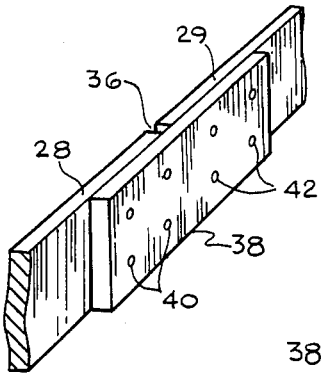
FIG. 4 depicts the construction of staggered joints for joining iron elements utilized in the construction of shielded rooms in accordance with the invention.
Figure 4A:
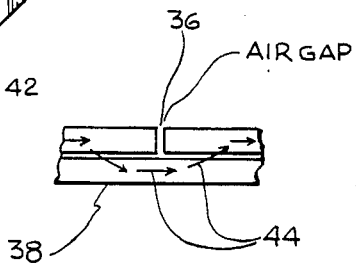

Referring now to FIG. 4, there is shown by way of example a plate segment, such as the one designated 28, which is separated from plate segment designated 29 by a narrow air gap 36 having a typical width of approximately a $\frac{1}{4}$ inch. In accordance with the staggered joint method, air gap 36 is bridged by a short segment 38, comprised of the same material and having the same thickness as segments 28 and 29, which is bolted by means of bolts 40 and 42 to respective portions of sections 28 and 29. The length of bridging segment 38 is typically selected to be approximately 6 times the thickness of elements 28 and 29. Thus, for a typical thickness of plates 28 and 29 of 3 inches, the length of section 38 would be 18 inches. In this manner, as is evident by reference to the enlarged view of the joint, segment 38 provides a path for the magnetic flux to bridge gap 36 as suggested by arrows 44. The staggered joint method may be used ot join a single plate. It will be recognized that, advantageously, as in the case of the shielded room embodiment disclosed with reference to FIG. 3, bridging segment 38 may comprise an adjacent wall plate, such as the one designated 25*a*.

Figure 5:
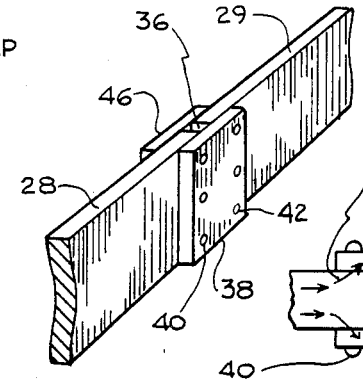
FIG. 5 is similar to FIG. 4, but depicts lap joints useful in constructing shielded rooms.
Figure 5A:
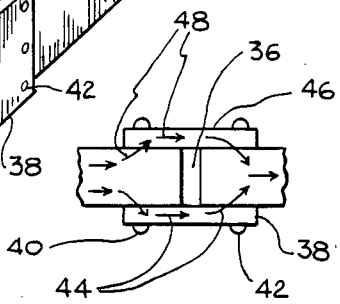

In the lap joint, which may also be used to join a single plate, depicted in FIG. 5 is implemented in substantially the same manner as the staggered joint described with reference to FIG. 4. In this case, however, an additional bridging element 46 is provided on the side of segments 28 and 29 opposite to that of bridging segment 38. In this case, dual flux paths are provided around the air gap as suggested by arrows 44 and 48, so that bridging elements 38 and 46 need only be one half as thick as the single element utilized in the staggered joint. In the embodiment of the shielded room described with reference to FIG. 3, the lap joint method is also used to join the segments comprising plate 25*a*, which is interposed between plates 24*a* and 26*a*.

Figure 6:
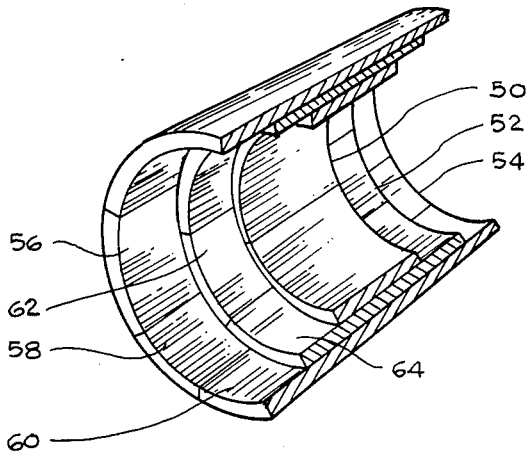
FIG. 6 depicts a perspective cut-away view of another exemplary embodiment having a cylindrical configuration and which is constructed in accordance with the invention.
Figure 7:
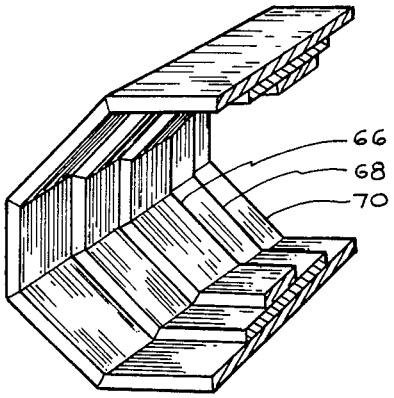
FIG. 7 depicts as yet another exemplary embodiment of a shielded room in accordance with the invention similar to that of FIG. 6, but constructed to have polygonal configuration.

FIGS. 6 and 7 illustrate cut-away perspective views of two additional exemplary embodiments of an NMR shielded room in accordance with the invention. FIG. 6 depicts a cylindrically configured room comprised of, for example, three cylindrical staggered members 50, 52, and 54 arranged coaxially relative to one another. In the preferred embodiment, elements 50, 52, and 54 may be advantageously constructed from rolled sectorial sections 56, 58, and 60, for example. To minimize obstructions to the flux path, sections 56, 58, and 60 are selected to extend along the length of the cylinder parallel to the cylindrical axis and to the axis of the magnet (not shown in this figure). Additionally, to minimize magnetic flux leakage, the sectorial sections (e.g., 56, 58, 60) in one of the cylindrical members are offset relative to the sectorial sections (e.g., 62, 64) of another cylindrical member such that the seam between adjacent sectorial sections is bridged by the continuous portion of another sectorial section.

The polygonal shielded room geometry depicted in FIG. 7 is similar to the cylindrical geometry described with reference to FIG. 6. In this case, the shielded room is constructed to have an octagonal geometry wherein octagonally-shaped members 66, 68, and 70 are staggered and disposed coaxially relative to one another.

As in the case of the embodiment of FIG. 3, the order of plates 50, 52, 54 (FIG. 6) and 66, 68, 70 (FIG. 7) could be reversed so that the shortest members are outermost, while the longest are innermost. Additionally, the stagger and lap techniques for joining plates are advantageously employed in the embodiments of FIGS. 6 and 7.

In each of the embodiments of FIG. 6 and 7, in a manner similar to that described with reference to FIG. 3, the shielding material is proportional to the amount of flux being conducted. It is desired to maintain a constant flux density throughout the shield. The flux density should be as high as possible without saturating the material. The flux being conducted at any point within the shield is a function of shield location and magnetic field intensity. Since the magnetic field and shield are a continuum type of problem, the ideal variation in shield thickness would be that of a continually varying thickness. For construction simplicity, a series of discrete thickness steps are used, thus approximating a constant flux density. It will be recognized, of course, that geometries other than those described hereinabove may be advantageously utilized in practicing the invention.

Figure 8:
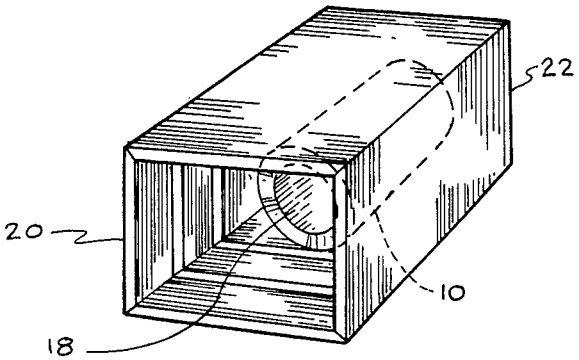
FIG. 8 depicts one embodiment of the shielded room similar to that depicted in FIG. 3.

In general, shielding material comprising the shielded room is disposed parallel to the bore of the magnet. A typical room shield, such as that depicted in FIG. 8, which utilizes the configuration described with reference to FIG. 3 and in which like parts are assigned like reference numbers, is made up of two side wall members, floor and ceiling shielding members, but with no shielding on the walls perpendicular to bore 18 of magnet 10. This is due to the fact that it is desirable to locate the shielding material such that it is substantially tangential to the flux path; i.e., the shield configuration should approximate the path that flux would normally follow. Therefore, shielding material placed parallel to the bore of the magnet, as shown in FIG. 8, is particularly effective in containing the magnetic flux fringe fields. However, of the six sides of the room, the placement of shielding of the room walls perpendicular to the bore of the magnet is least effective because in this region the flux lines emanating from the bore of the magnet would tend to intercept to shield material at relatively acute angles rather than tangentially. A further reason why shielding material is not typically employed on shield walls perpendicular to the bore of the magnet is that access to the room is necessary.

It is possible, however, to utilize, in accordance with the invention, partial shielding of the walls perpendicular to the bore of the magnet to significantly improve containment of the fringe field and the homogeneity of the magnetic field within the bore of the magnet, while optimizing the use of shielding material, as well as providing access to the room.

Figure 9:
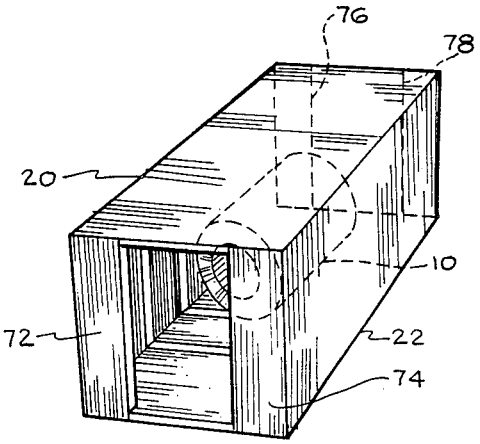
FIGS. 9, 10, and 11 depict shielded rooms constructed in accordance with the invention and which include end-cap elements having varying configurations.

Referring now to FIG. 9, there shown a shield room having a configuration substantially similar to that depicted in FIG. 8, but additionally including end-cap elements 72 and 74 at one end of the shield room and elements 76 and 78 at the opposite end. In general, it is desirable to maintain symmetry so as to avoid disturbing the homogeneity of the magnetic field. In this case, the end-cap elements only partially cover the opening perpendicular to the bore of the magnet, starting at the edges of side wall members 20 and 22 and extending toward the center. The space remaining unshielded is determined by the minimum opening required for access into the MR room. The size of the opening in the wall, however, has an effect on the homogeneity of the field within the bore of the magnet, so that in some situations this requirement may be the deciding factor as to how large an opening is desirable. The effect on homogeneity is due to the fact that the end-cap elements act as magnets while conducting the fringe field flux and, therefore, have an effect on the homogeneity of the field produced by the magnet 10. It will be recognized that the end-cap elements must be intimately connected to the side wall members, since any gap therebetween reduces the effectiveness of the end cap. Additionally, as the end-cap area is increased and the opening descreased, every additional amount of area added to the end cap improves shielding capability, but at a diminishing return on the amount shielding material added. Therefore, the size of the opening in the shield room is dependent upon room access, magnet homogeneity, and shield weight requirements.

Figure 10:
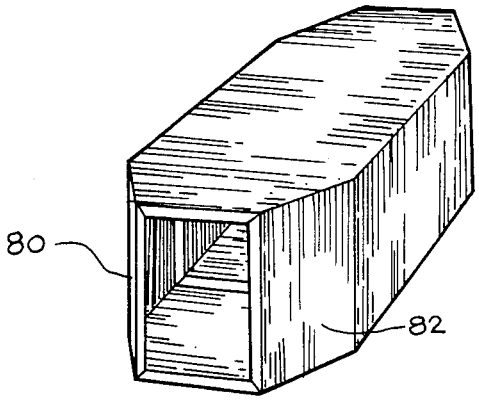

The performance of the shielded room can be improved and the use of shielding material optimized if the end-cap elements are angled away from the side wall members in a direction that more naturally follows the path of flux in space. To this end, FIG. 10 depicts a pair of end-cap elements 80 and 82 which extend from the edges of the side wall members toward the center of the room. A similar pair of end-cap elements is provided on the side of the room not visible in the Figure, so as to maintain symmetry.

Figure 11:
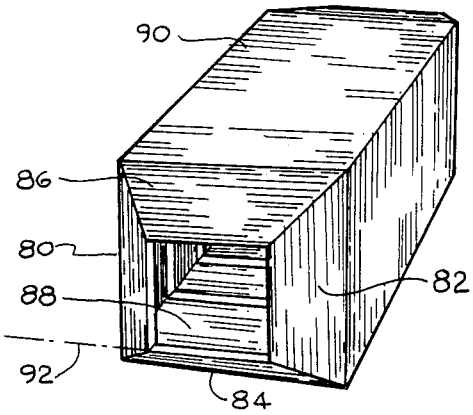

The design of the shield room can be further optimized by including an additional pair of end-cap elements 84 and 86 shown in FIG. 11 extending from the edges of the floor and ceiling elements 88 and 90, respectively, toward the center of the opening. In the embodiment depicted in FIG. 11, due to the fact that end-cap element 84 angles from floor element 88 upward, it is necessary that the portion of the shield room lying below dash line 92 be constructed below floor level so as to permit easy entry into the examining room.

While this invention has been described with reference to particular embodiments and examples, other modifications and variations will occur to those skilled in the art in view of the above teachings. Accordingly, it should be understood that within the scope of the appended claims the invention may be practiced otherwise than is specifically described.

The invention claim is:

1. A shielded room for containing a fringe magnetic field generated by a magnet housed therein, comprising:

a shield composed of a material suitable for containment of the fringe field, said shield including at least one wall section having different thicknesses in some regions thereof than in others, wherein the thickness of said wall section is determined by the strength of the fringe magnetic field to be contained by a given region of said wall section, the minimum wall section thickness being selected so as not to exceed by a substantial amount the thickness required to contain the fringe field without saturating the material, thereby to minimize the total quantity of material in said shield.

2. The shielded room of claim 1 wherein said material comprises a low-carbon steel alloy.

3. The shielded room of claim 1 wherein said shield comprises at least one wall member, which member is disposed substantially tangentially to the fringe magnetic field.

4. The shielded room of claim 1 wherein said shield comprises a pair of side wall members, a ceiling member and a floor member, all of said members being disposed substantially tangentially to the fringe magnetic field.

5. The shielded room of claim 4 wherein said side wall members comprise a plurality of plate members of different lengths, said plate members being disposed adjacent to one another such that longer ones of said plate members extend beyond the ends of shorter ones of said plate members.

6. The shielded room of claim 5 wherein at least one of said plate members comprises a plurality of elongated segments, the individual lengths of at least some of said elongated segments being shorter than the total length of said one plate member, wherein a plurality of said shorter segments are joined to have a length equal to that of said one plate member, the joint between said shorter segments being disposed relative to at least one other of said adjacent plate members so as to be bridged by a continuous portion thereof.

7. The shielded room of claim 5 wherein said side wall members further comprise end-cap means extending from the edges thereof toward the midpoint between said side wall members.

8. The shielded room of claim 4 wherein said ceiling and floor members each comprise a plurality of plate members of different lengths, said plate members being disposed adjacent to one another such that longer ones of said plate members extend beyond the ends of shorter ones of said plate members.

9. The shielded room of claim 8 wherein said ceiling and floor members further comprise end-cap means extending from the edges thereof toward the midpoint between said side wall members.

10. The shielded room of claim 1 wherein said shield comprises a plurality of coaxially disposed cylindrical members of different lengths, said cylindrical members being staggered relative to one another such that longer ones of said members extend beyond the ends of shorters ones of said members.

11. The shielded room of claim 10 wherein at least one of said cylindrical members comprises a plurality of axial elongated segments, the individual lengths of at least some of said elongated segments being shorter than the total length of said one cylindrical member, wherein a plurality of said shorter segments are joined to have a length equal to that of said one cylindrical member, the joint between said shorter segments being disposed relative to at least one other of said plate members so as to be bridged by a continuous portion thereof.

12. The shield room of claim 1 wherein said shield comprises a plurality of coaxially disposed polygonal members of different lengths, said polygonal members being staggered relative to one another such that longer ones of said members extend beyond the ends of shorter ones of said members.

13. The shielded room of claim 12 wherein at least one of said polygonal members comprises a plurality of elongated segments, the individual lengths of at least some of said elongated segments being shorter than the total length of said one polygonal member, wherein a plurality of said shorter segments are joined to have a length equal to that of said one polygonal member, the joint between said shorter segments being disposed relative to at least one other of said polygonal members so as to be bridged by a continuous portion thereof.

14. A shielded room for containing a fringe magnetic field generated by a magnet housed therein, comprising:

a shield, forming at least a portion of the periphery of the shielded room, composed of a material suitable for containment of the fringe field, said shield including at least one wall section having different thicknesses in some regions thereof than in others, wherein the thickness of said wall section is determined by the strength of the fringe magnetic field to be contained by a given region of said wall section, the minimum wall section thickness being selected so as not to exceed by a substantial amount the thickness required to contain the fringe field without saturating the material, thereby to minimize the total quantity of material in said shield.

15. The shielded room of claim 14 wherein said material comprises a low-carbon steel alloy.

16. The shielded room of claim 14 wherein said shield comprises at least one wall member, which member is disposed substantially tangentially to the fringe magnetic field.

17. The shielded room of claim 14 wherein said shield comprises a pair of side wall members, a ceiling member and a floor member, all of said members being disposed substantially tangentially to the fringe magnetic field.

18. The shielded room of claim 17 wherein said side wall members comprise a plurality of plate members of different lengths, said plate members being disposed adjacent to one another such that longer ones of said plate members extend beyond the ends of shorter ones of said plate members.

19. The shielded room of claim 18 wherein at least one of said plate members comprises a plurality of elongated segments, the individual lengths of at least some of said elongated segments being shorter than the total length of said one plate member, wherein a plurality of said shorter segments are joined to have a length equal to that of said one plate member, the joint between said shorter segments being disposed relative to at least one other of said adjacent plate members so as to be bridged by a continuous portion thereof.

20. The shielded room of claim 18 wherein said side wall members further comprise end-cap means extending from the edges thereof toward the midpoint between said side wall members.

21. The shielded room of claim 17 wherein said ceiling and floor members each comprise a plurality of plate members of different lengths, said plate members being disposed adjacent to one another such that longer ones of said plate members extend beyond the ends of shorter ones of said plate members.

22. The shielded room of claim 21 wherein said ceiling and floor members further comprise end-cap means extending from the edges thereof toward the midpoint between said side wall members.

23. The shielded room of claim 14 wherein said shield comprises a plurality of coaxially disposed cylindrical members of different lengths, said cylindrical members being staggered relative to one another such that longer ones of said members extend beyond the ends of shorter ones of said members.

24. The shielded room of claim 23 wherein at least one of said cylindrical members comprises a plurality of axial elongated segments, the individual lengths of at least some of said elongated segments being shorter than the total length of said one cylindrical member, wherein a plurality of said shorter segments are joined to have a length equal to that of said one cylindrical member, the joint between said shorter segments being disposed relative to at least one other of said plate members so as to be bridged by a continuous portion thereof.

25. The shield room of claim 14 wherein said shield comprises a plurality of coaxially disposed polygonal members of different lengths, said polygonal members being staggered relative to one another such that longer ones of said members extend beyond the ends of shorter ones of said members.

26. The shielded room of claim 25 wherein at least one of said polygonal members comprises a plurality of elongated segments, the individual lengths of at least some of said elongated segments being shorter than the total length of said one polygonal member, wherein a plurality of said shorter segments are joined to have a length equal to that of said one polygonal member, the joint between said shorter segments being disposed relative to at least one other of said polygonal members so as to be bridged by a continuous portion thereof.

* * * * *